US008539958B2

(12) United States Patent
Mishra et al.

(10) Patent No.: US 8,539,958 B2
(45) Date of Patent: Sep. 24, 2013

(54) ORAL MOIST SMOKELESS TOBACCO PRODUCTS WITH NET-STRUCTURED GEL COATING AND METHODS OF MAKING

(75) Inventors: Munmaya K. Mishra, Manakin Sabot, VA (US); Shengsheng Liu, Richmond, VA (US); William R. Sweeney, Richmond, VA (US); Szu-Sung Yang, Midlothian, VA (US); Dennis Geib, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 12/790,043

(22) Filed: May 28, 2010

(65) Prior Publication Data

US 2011/0100382 A1 May 5, 2011

Related U.S. Application Data

(63) Continuation of application No. 12/577,859, filed on Oct. 13, 2009, now abandoned.

(51) Int. Cl.
*A24B 15/00* (2006.01)

(52) U.S. Cl.
USPC ..... 131/352; 131/111

(58) Field of Classification Search
None
See application file for complete search history.

(56) References Cited

U.S. PATENT DOCUMENTS

| | | | |
|---|---|---|---|
| 865,026 | A | 11/1907 | Ellis |
| 904,521 | A | 11/1908 | Ellis |
| 1,376,586 | A | 5/1921 | Schwartz |
| 4,513,756 | A | 4/1985 | Pittman et al. |
| 4,543,370 | A | 9/1985 | Porter et al. |
| 4,545,392 | A | 10/1985 | Sensabaugh, Jr. et al. |
| 4,624,269 | A | 11/1986 | Story et al. |
| 4,683,256 | A | 7/1987 | Porter et al. |
| 4,817,640 | A | 4/1989 | Summers |
| 4,917,161 | A | 4/1990 | Townend |

(Continued)

FOREIGN PATENT DOCUMENTS

| | | |
|---|---|---|
| WO | WO 03/053175 A | 7/2003 |
| WO | WO 2006/004480 | 1/2006 |

(Continued)

OTHER PUBLICATIONS

International Search Report and Written Opinion dated Sep. 17, 2008 for PCT/IB2007/004216.

(Continued)

*Primary Examiner* — Michael J Felton
(74) *Attorney, Agent, or Firm* — Buchanan Ingersoll & Rooney PC

(57) ABSTRACT

Oral tobacco products having a gel-coating and methods for making are provided. The method includes (a) molding a portion of tobacco material to form a pre-portioned piece of tobacco material, the tobacco material comprising moist smokeless tobacco; (b) contacting the pre-portioned piece of tobacco material with a gel-coating solution to form a gel-coating comprising at least one polymer on an outer surface of the pre-portioned piece of tobacco material to form a gel-coated oral tobacco product, said gel-coating comprising an inner surface disposed around the pre-portioned piece of tobacco material and an outer surface; and (c) forming one or more of perforations, uncoated areas and holes in the gel-coating of the oral tobacco product to form a gel-coated oral tobacco product.

7 Claims, 1 Drawing Sheet

(56) References Cited

U.S. PATENT DOCUMENTS

| | | | |
|---|---|---|---|
| 4,975,270 | A | 12/1990 | Kehoe |
| 5,092,352 | A | 3/1992 | Sprinkle, III et al. |
| 5,175,277 | A | 12/1992 | Rakitsky et al. |
| 5,387,416 | A | 2/1995 | White et al. |
| 6,162,516 | A | 12/2000 | Derr |
| 6,325,859 | B1 | 12/2001 | De Roos et al. |
| 7,032,601 | B2 | 4/2006 | Atchley et al. |
| 2003/0224090 | A1 | 12/2003 | Pearce et al. |
| 2004/0118421 | A1 | 6/2004 | Hodin et al. |
| 2004/0118422 | A1 | 6/2004 | Lundin et al. |
| 2004/0247649 | A1 | 12/2004 | Pearce et al. |
| 2004/0247744 | A1 | 12/2004 | Pearce et al. |
| 2004/0247746 | A1 | 12/2004 | Pearce et al. |
| 2005/0003048 | A1 | 1/2005 | Pearce et al. |
| 2005/0061339 | A1 | 3/2005 | Hansson et al. |
| 2005/0067726 | A1 | 3/2005 | Yan et al. |
| 2005/0100640 | A1 | 5/2005 | Pearce |
| 2005/0244521 | A1 | 11/2005 | Strickland et al. |
| 2006/0073190 | A1 | 4/2006 | Carroll et al. |
| 2006/0144412 | A1 | 7/2006 | Mishra et al. |
| 2006/0191548 | A1 | 8/2006 | Strickland et al. |
| 2007/0003663 | A1 | 1/2007 | Jani et al. |
| 2007/0012328 | A1 | 1/2007 | Winterson et al. |
| 2007/0062549 | A1 | 3/2007 | Holton, Jr. et al. |
| 2007/0122455 | A1 | 5/2007 | Myers et al. |
| 2007/0186844 | A1 | 8/2007 | Weisleder et al. |
| 2007/0186941 | A1 | 8/2007 | Holton, Jr. et al. |
| 2007/0186942 | A1 | 8/2007 | Strickland et al. |
| 2007/0186943 | A1 | 8/2007 | Strickland et al. |
| 2007/0186944 | A1 | 8/2007 | Strickland et al. |
| 2007/0190157 | A1 | 8/2007 | Sanghvi et al. |
| 2008/0029110 | A1 | 2/2008 | Dube et al. |
| 2008/0029116 | A1 | 2/2008 | Robinson et al. |
| 2008/0029117 | A1 | 2/2008 | Mua et al. |
| 2008/0081071 | A1 | 4/2008 | Sanghvi et al. |
| 2008/0173317 | A1 | 7/2008 | Robinson et al. |
| 2008/0202533 | A1 * | 8/2008 | Mishra et al. ..... 131/119 |
| 2009/0038631 | A1 | 2/2009 | Mishra et al. |
| 2009/0301505 | A1 | 12/2009 | Liu et al. |

FOREIGN PATENT DOCUMENTS

| | | |
|---|---|---|
| WO | WO 2006/065192 | 6/2006 |
| WO | WO 2006/105173 | 10/2006 |
| WO | WO 2008/059375 A | 5/2008 |

OTHER PUBLICATIONS

International Search Report and Written Opinion dated Mar. 30, 2009 for PCT/IB2008/002883.

International Preliminary Report on Patentability and Written Opinion dated May 19, 2009 for PCT/IB2007/004216.

International Preliminary Report on Patentability issued Feb. 9, 2010 for PCT/IB2008/002883.

International Search Report and Written Opinion mailed Aug. 25, 2009 for PCT/IB2009/000385.

International Search Report and Written Opinion mailed May 3, 2011 for International Application No. PCT/EP2010/006193.

U.S. Appl. No. 12/576,986, filed Oct. 9, 2009.

U.S. Appl. No. 12/748,272, filed Mar. 26, 2010.

International Preliminary Report on Patentability issued Aug. 10, 2010 for International Application No. PCT/IB2009/000385.

International Preliminary Report on Patentability issued Apr. 17, 2012 for PCT/EP2010/006193.

* cited by examiner

ORAL MOIST SMOKELESS TOBACCO PRODUCTS WITH NET-STRUCTURED GEL COATING AND METHODS OF MAKING

CROSS REFERENCE TO RELATED APPLICATION

This application is a continuation application of U.S. application Ser. No. 12/577,859 entitled ORAL MOIST SMOKELESS TOBACCO PRODUCTS WITH NET-STRUCTURED GEL COATING AND METHODS OF MAKING, filed on Oct. 13, 2009 now abandoned, the entire content of which is hereby incorporated by reference.

SUMMARY

According to one embodiment, a method for making an oral tobacco product having a net-structured gel coating comprises (a) molding a portion of tobacco material to form a pre-portioned piece of tobacco material; (b) contacting the pre-portioned piece of tobacco material with a gel-coating solution to form a gel-coating comprising at least one polymer on an outer surface of the pre-portioned piece of tobacco material to form a gel-coated oral tobacco product, said gel-coating comprising an inner surface disposed around the pre-portioned piece of tobacco material and an outer surface; and (c) forming perforations, uncoated areas and/or holes in the gel-coating of the oral tobacco product to form a net-structured gel-coated oral tobacco product. Preferably, the net-structured gel-coating is insoluble in a user's mouth such that the tobacco material enclosed by the net-structured gel-coating is contained during placement, use and removal of the product from the user's mouth.

According to another embodiment, a pre-portioned oral tobacco product comprises a pre-portioned piece of tobacco material; and a net-structured gel-coating having perforations, uncoated areas and/or holes extending through a thickness of the gel-coating. The gel-coating comprises at least one insoluble polymer.

BRIEF DESCRIPTION OF THE DRAWING FIGURES

DETAILED DESCRIPTION

Figure 1:
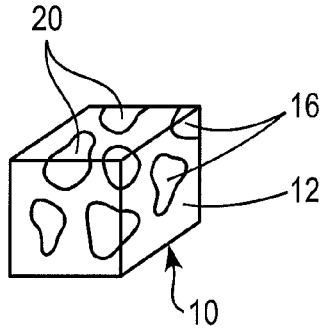
FIG. 1 is an illustration of pre-portioned oral tobacco product having a net structured gel coating.

Provided herein are pre-portioned oral tobacco product and methods for preparing pre-portioned oral tobacco product having a net-structured, gel-coating as the pouch wrapper. Preferably, the net-structured, gel-coating contains a plurality of perforations, uncoated areas and/or holes extending through the thickness of the gel-coating such that the underlying tobacco material is exposed. The perforations, uncoated areas and/or holes are separated from each other by regions of solid gel-coating material. Preferably, the perforations, uncoated areas and/or holes permit saliva to easily penetrate the pouch wrapper and come into contact with the tobacco material, where flavorants, colorants, chemesthetic agents, and other additives are extracted into the saliva. The perforations, uncoated areas and/or holes also permit the movement of the saliva from the tobacco material and into the oral cavity, where it comes into contact with sensory organs, such as those in the tongue.

The methods described herein provides a simple, controllable technique for controlling the size and number of these perforations, uncoated areas and/or holes, and therefore helps to provide control over the release rate of the juices, flavorants and/or other additives of the inner filling material from the oral pouch product.

In a first method, a quantity of tobacco material, such as moist smokeless tobacco (MST), is molded into a predefined shape. In a preferred embodiment, about 0.5 grams to about 2.5 grams of tobacco material is molded. Preferably, the tobacco material is molded to a suitable size and configuration that fits comfortably between a user's cheek and gum. The tobacco material can be formed in many shapes including, without limitation, spheres, rectangles, oblong shapes, crescent shapes, ovals, cubes and/or any other shape. The shaped tobacco material can be symmetrical or asymmetrical. Preferably, the shaped tobacco material has smooth and/or rounded edges that are comfortable when the tobacco material is placed in a user's mouth.

In a particular embodiment, the tobacco material can include cut or ground tobacco and can include flavorants and/or other additives. Examples of suitable types of tobacco materials that may be used include, but are not limited to, flue-cured tobacco, Burley tobacco, Maryland tobacco, Oriental tobacco, rare tobacco, specialty tobacco, reconstituted tobacco, blends thereof and the like. The tobacco material may be pasteurized or may be fermented, or a combination of pasteurized and fermented tobacco material may be used. The tobacco material may be provided in any suitable form, including shreds and/or particles of tobacco lamina, processed tobacco materials, such as volume expanded or puffed tobacco, or ground tobacco, processed tobacco stems, such as cut-rolled or cut-puffed stems, reconstituted tobacco materials, blends thereof, and the like. Genetically modified tobacco may also be used. Preferably, the tobacco material includes moist smokeless tobacco.

The tobacco material can also include a supplemental amount of a tobacco substitute material, such as fruit, vegetable or plant fibers or particles such as particles or shreds of lettuce, cotton, flax, beet fiber, cellulosic fibers, blends thereof and the like.

In one embodiment, the tobacco material is completely disintegrable in a user's mouth so that once the tobacco material has disintegrated, a user may chew and ingest the remaining net-structured gel-coating so that nothing remains in the user's mouth. In another embodiment, the tobacco material does not disintegrate in the user's mouth and must be removed for disposal.

Preferably, the moisture content of the tobacco material before and after coating is about 25% to about 65%. Also preferably, the tobacco material has a water activity of about 0.75 aw to about 0.86 aw both before and after formation of the net-structured gel-coating thereon.

After molding, the pre-portioned, shaped tobacco material is then dipped into a coating solution containing at least one polymer to form a gel-coated tobacco product. The concentration of the coating solution is about 0.1 wt % to about 20 wt % polymer in the solution (e.g., about 0.5 wt % to about 15 wt %, about 0.75 wt % to about 10 wt % or about 1.0 wt % to about 5 wt %). Most preferably, the concentration of the polymer coating solution is about 1.0 wt % to about 1.5 wt % of the polymer with the balance being water. In an embodiment, the shaped tobacco material and gel-coating can be formed as in U.S. Application Publication No. 2008/0202533

A1, filed on Nov. 13, 2007, the entire content of which is incorporated herein by reference.

The concentration of the polymer in the polymer coating solution determines the thickness of the gel-coating. Polymer coating solutions having a higher polymer concentration form thicker gel-coatings than polymer coating solutions having lower polymer concentrations. Thus, the concentration of the polymer in the coating solution can be modified to form a gel-coating having a preferred thickness.

Once coated, the gel-coated tobacco material is dried. In one embodiment, the gel-coated tobacco material can be dried at room temperature under a hood for about 5 minutes to about 3 hours (e.g., about 10 minutes to about 2 hours, about 15 minutes to about 1 hour or about 20 minutes to about 40 minutes). Alternatively, the gel-coated tobacco material can be dried for about 30 minutes to about 2 hours in a 60° C. convection oven. More preferably, the gel-coated tobacco material can be dried for about 1 hour in a 60° C. convection oven. In yet another embodiment, the gel-coated tobacco material is patted dry so that the moisture content remains high in both the gel-coating and the tobacco material.

After drying, the final moisture content of the gel-coating is about 10% to about 50%, more preferably about 25% to about 35%, and most preferably about 30%. Preferably, the tobacco material is monitored during drying so that the water activity of the tobacco material in the final product is about 0.85 aw to about 0.86 aw.

Once the gel-coated tobacco material has been dried, perforations, uncoated areas and/or holes are formed in the gel-coating of the to form a net-structured, gel-coating. In a first embodiment, the perforations, uncoated areas and/or holes can be formed with one or more needles. The needle can be a 16 gauge needle. Needles of other sizes can also be used so long as the needle is sufficiently large to form a net-structure having suitably sized perforations, uncoated areas and/or holes therein. Preferably, the perforations, uncoated areas and/or holes only extend through the gel-coating. In other embodiments, the perforations, uncoated areas and/or holes can be formed with tools such as a laser.

As used herein, the terms "net-structure" and "net-structured" refer to a non-continuous gel-coating having regions of coverage of the underlying tobacco material and regions lacking coverage. Thus, the "net-structured" gel-coating has perforations, uncoated areas and/or holes in the gel-coating that expose the tobacco material and allow free flow of juices and/or saliva into and out of the underlying gel-coated tobacco material.

Preferably, the perforations, uncoated areas and/or holes range in size from about 0.001 mm to about 5.0 mm in length and width (e.g., about 0.01 mm to about 4.0 mm, about 0.1 mm to about 3.0 mm or about 1.0 mm to about 2.0 mm). Also preferably, the perforations, uncoated areas and/or holes extend only through the gel-coating. The perforations, uncoated areas and/or holes are preferably formed so as to be large enough to allow the unencumbered flow of juices, while remaining small enough to prevent shreds of particles of the enclosed tobacco material from traveling through the perforations, uncoated areas and/or holes and into the user's mouth. The size of the perforations, uncoated areas and/or holes can be altered for desired saliva flow so that the perforations, uncoated areas and/or holes can provide immediate, unencumbered flow of saliva into and out of the tobacco material.

The perforations, uncoated areas and/or holes can be uniform over the entire gel-coating or randomly placed therein. In an embodiment, the perforations, uncoated areas and/or holes can be made through the gel-coating in a set pattern. The perforations, uncoated areas and/or holes can be formed with uniform or non-uniform cross-sections in any shape including circles, triangles, lines, squares, ovals and the like. Preferably, the number of perforations, uncoated areas and/or holes is selected to provide for optimal flavor delivery when the net-structured, gel-coated MST product is placed in the user's mouth. A larger number of perforations, uncoated areas and/or holes formed in a gel-coating allows for greater flow of saliva and flavors. Likewise, a smaller number of perforations, uncoated areas and/or holes can limit the flow of saliva and flavors into and/or out of the tobacco product.

Preferably, the gel-coating is a single layer coating that coats a portion of tobacco material with at least one polymer. In an embodiment, the gel-coating comprises two or more polymers having the same or different solubility in saliva. Preferably, the polymers are hydrocolloids. More preferably, the polymers are polysaccharides.

When the gel-coating includes multiple polymers, at least one of the polymers can be a soluble component and/or at least one of the polymers can be an insoluble component. In a preferred embodiment, the gel-coating includes at least one insoluble component. When the gel-coating includes both a soluble component and an insoluble component, the soluble component is dissolved out to form perforations, uncoated areas and/or holes prior to use leaving the insoluble component behind to form the net-structured, gel-coating by one of the methods described herein. Preferably, the insoluble component does not dissolve in the user's mouth and thus holds the tobacco material together during use. Once the user has finished using the product, the product can easily be removed from the mouth because the insoluble component maintains the product in a unitary form. Preferably, the insoluble component includes at least one insoluble biopolymer. The insoluble biopolymer can be a cross-linkable polymer.

Suitable non-cross-linkable polymers include, without limitation, starch, dextrin, gum arabic, guar gum, chitosan, cellulose, polyvinyl alcohol, polylactide, gelatin, soy protein and/or whey protein.

If the insoluble component is cross-linked, cross-linking can be conducted with a cross-linking solution including a monovalent metal ion salt or a bivalent metal ion salt. While both monvalent and bivalent metal ion salts may be used, preferably a bivalent metal ion salt is used. Suitable bivalent metal ion salts include, without limitation, calcium lactate, calcium chloride, calcium sorbate, calcium propionate and the like. Calcium lactate is preferred since it is approved for use in food products. For example, the cross-linking solution can be a 2.0 wt % calcium lactate solution.

In an embodiment, a soluble component can also be formed as part of the net-structured, gel-coating. The soluble component preferably dissolves to form additional perforations upon placement in the user's mouth and thus can form additional perforations that provide immediate access to flavors and moisture. The soluble component can be formed of a non-chemically-cross-linkable polymer.

Suitable chemically-cross-linkable polymers include, without limitation, alginate, pectin, carrageenan, and modified polysaccharides with cross-linkable functional groups. The preferred non-chemically-cross-linkable polymers are alginate and pectin.

In an embodiment, additional flavorants and/or other additives, such as sweeteners, preservatives, nutraceuticals, antioxidants, amino acids, minerals, vitamins, botanical extracts, humectants and/or chemesthetic agents, can be included in the coating solution prior to formation of the coating, within the perforations after formation thereof and/or within the tobacco material.

Suitable flavorants include, but are not limited to, any natural or synthetic flavor or aroma, such as tobacco, smoke, menthol, peppermint, spearmint, chocolate, licorice, citrus, gamma octalactone, vanillin, ethyl vanillin, breath freshener flavors, cinnamon, methyl salicylate, linalool, bergamot oil, geranium oil, lemon oil, ginger oil, pomegranate, acai, raspberry, blueberry, strawberry, boysenberry, cranberry, bourbon, scotch, whiskey, cognac, hydrangea, lavender, apple, peach, pear, cherry, plum, orange, lime, grape, grapefruit, butter, rum, coconut, almond, pecan, walnut, hazelnut, french vanilla, macadamia, sugar cane, maple, cassis, caramel, banana, malt, espresso, kahlua, white chocolate, clove, cilantro, basil, oregano, garlic, mustard, nutmeg, rosemary, thyme, tarragon, dill, sage, anise, fennel, jasmine, coffee, olive oil, sesame oil, sunflower oil, balsamic vinegar, rice wine vinegar, or red wine vinegar. Other suitable components may include flavor compounds selected from the group consisting of an acid, an alcohol, an ester, an aldehyde, a ketone, a pyrazine, combinations or blends thereof and the like. Suitable flavor compounds may be selected, for example, from the group consisting of phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-valeric acid, combinations thereof and the like.

Suitable sweeteners include, without limitation water soluble sweeteners, such as monosaccharides and disaccharides, such as xylose, ribose, sucrose, maltose, fructose, glucose and/or mannose. Polysaccharides may also be included, as well as sugar alcohols and non-nutritive sweeteners.

Suitable chemesthetic agents include, but are not limited to, capsaicin, tannins, mustard oil, wintergreen oil, cinnamon oil, allicin, quinine, citric acid, and salt.

Suitable vitamins include, without limitation, vitamin A (retinol), vitamin D (cholecalciferol), vitamin E group, vitamin K group (phylloquinones and menaquinones), thiamine (vitamin $B_1$), riboflavin (vitamin $B_2$), niacin, niacinamide, pyridoxine (vitamin $B_6$ group), folic acid, choline, inositol, vitamin $B_{12}$ (cobalamins), PABA (para-aminobezoic acid), biotin, vitamin C (ascorbic acid), and mixtures thereof. The amount of vitamins can be varied according to the type of vitamin and the intended user of the pre-portioned product. For example, the amount of vitamins may be formulated to include an amount less than or equal to the recommendations of the United States Department of Agriculture Recommended Daily Allowances.

As used herein, the term "nutraceuticals" refers to any ingredient in foods that has a beneficial effect on human health. Nutraceuticals include particular compounds/compositions isolated from natural food sources and genetically modified food sources. For example, nutraceuticals include various phytonutrients derived from natural plants and genetically engineered plants.

Suitable minerals include, without limitation, calcium, magnesium, phosphorus, iron, zinc, iodine, selenium, potassium, copper, manganese, molybdenum, chromium, and mixtures thereof. The amount of minerals incorporated into the pre-portioned product can be varied according to the type of mineral and the intended user. For example, the amount of minerals may be formulated to include an amount less than or equal to the recommendations of the United States Department of Agriculture Recommended Daily Allowances.

Suitable amino acids include, without limitation, the essential amino acids that cannot be biosynthetically produced in humans, including valine, leucine, isoleucine, lysine, threonine, tryptophan, methionine, and phenylalanine. Examples of other suitable amino acids include the non-essential amino acids including alanine, arginine, asparagine, aspartic acid, cysteine, glutamic acid, glutamine, glycine, histidine, proline, serine, and tyrosine.

In another embodiment, the pre-portioned product can include various active agents having antioxidant properties that can delay the ageing process, as food-grade ingredients. For example, the antioxidants can include: active ingredients that can be extracted from *Ginkgo biloba*, including flavonoid glycosides ("ginkgoflavonoids"), such as (iso)quercitin, kaempferol, kaempferol-3-rhamnosides, isorhamnetin, luteolin, luteolin glycosides, sitosterol glycosides, and hexacyclic terpene lactones, referred to as "ginkgolides" or "bilobalides"; the active ingredients that can be extracted from *Camellia sinensis*, such as green tea, including various "tea tannins," such as epicatechol, epigallocatechol, epigallocatechol gallate, epigallocatechol gallate, theaflavin, theaflavin monogallate A or B, and theaflavin digallate; the active ingredients that can be extracted from *Vaccinium myrtillus*, such as blueberry, including at least 15 different anthocyanosides, such as delphinidin, anthocyanosides, myrtin, epimyrtin, phenolic acids, glycosides, quercitrin, isoquercitrin, and hyperoside; the active ingredients that can be extracted from *Vinis vitifera*, such as grapes, include polyphenols, catechols, quercitrins, and resveratrols; and the active ingredients that can be extracted from *Olea europensis*, such as the leaves of olive trees, include oleuropein. Many active ingredients identified from these and other plant sources associated with the neutralization of free radicals and useful for delaying the ageing process are contemplated as suitable for inclusion in the pre-portioned tobacco product described herein.

Suitable botanical extracts can include the active ingredients of *Trifolium pratense*, such as purple clovers (i.e., common purple trefoils), including isoflavones or isoflavone glucosides, daidzein, genestein, formononentin, biochanin A, ononin, and sissostrin. The health-promoting properties of compounds derived from *Panax*, a genus that includes Ginseng, are well-established and may also be included in the pre-portioned product. These and other botanicals, botanical extracts, and bioactive compounds having health promoting effects are contemplated.

Suitable preservatives include, without limitation, methyl paraben, propyl paraben, sodium propionate, potassium sorbate, sodium benzoate and the like. The preservatives can be included in an amount of about 0.001 wt % to about 20 wt %, and more preferably about 0.01 wt % to about 1.0 wt % (e.g., about 0.1 wt %), based upon the total weight of the gel-coating.

Humectants can also be added to the tobacco material to help maintain the moisture levels in the gel-coated MST product. Examples of humectants that can be used with the tobacco material include glycerol and propylene glycol. It is noted that the humectants can also be provided for a preservative effect, as the water activity of the product can be decreased with inclusion of a humectant, thus reducing opportunity for growth of micro-organisms. Additionally, humectants can be used to provide a higher moisture feel to a drier tobacco component.

Also preferably, the bulk density of the net-structured, gel-coated oral tobacco product is about $1.0 \pm 0.2$ g/cm$^3$.

In a preferred embodiment, the net-structured, gel-coating allows the tobacco juices and flavors to flow out of the gel-coating, while still providing a net structure that holds the tobacco material within the gel-coating intact through the duration of tobacco use. In addition, the gel-coating provides a soft compliant feel to the tongue and mouth tissues, while allowing unencumbered flow of juices into and out of the product.

If the gel-coating is peeled off the tobacco product and completely dried, the gel-coating is preferably about 0.02 mm to about 1.0 mm thick with perforations extending therethrough. More preferably, when the gel-coating is completely dried, the gel-coating is about 0.08 mm to about 0.14 mm thick with perforations extending therethrough. In a most preferred embodiment, the gel-coating when removed and completely dried is about 0.11 mm thick with perforations extending therethrough.

The methods described herein can be more clearly understood by reference to the following non-limiting examples.

EXAMPLE 1

1.5 grams of MST is molded into a cube shape to form a pre-portioned piece of MST. The pre-portioned piece of MST is then dipped into a coating solution comprising 4% pectin, 0.15% alginate, 4% dextrin and balance water to form a coated MST product. The coated MST product is then dried at room temperature to remove excess water. The coating of the dried, coated MST product is then perforated with a 16 gauge needle to create a coating having a net-structure.

EXAMPLE 2

1.5 grams of MST is molded into a cube shape to form a pre-portioned piece of MST. The pre-portioned piece of MST is then dipped into a coating solution comprising 4% pectin, 0.15% alginate, 4% dextrin and balance water to form a coated MST product. The coated MST product is then dried at room temperature for about 2 to about 3 hours to remove excess water. The coating of the MST product is then perforated with a laser to create a coating having a net-structure.

In a second method, the net-structured gel-coating is formed on the molded portion of tobacco material, such as MST, by placing a mesh form or sieve over and around the molded portion of tobacco material. Then, a polymeric solution comprising at least one biopolymer is poured and/or sprayed over the mesh. Alternatively, the mesh covered tobacco material is dipped into the polymeric solution to form a gel-coated tobacco product. The gel-coated tobacco product is then dried and the mesh form is removed from the gel-coated tobacco product, leaving behind a net-structured gel-coating formed by the polymeric material, which contacts and adheres to the molded tobacco material that is left exposed once the mesh form is removed. Perforations, holes and/or uncoated regions remain where the mesh form or sieve was placed on the tobacco material.

EXAMPLE 3

1.5 grams of MST is molded into a cube shape to form a pre-portioned piece of MST. Then, a 40 mesh test sieve is placed over the pre-portioned piece of MST. A coating solution of 2.5% pectin, 0.15% alginate, 4% dextrin and balance water is sprayed onto the pre-portioned piece of MST through the sieve. The gel-coated MST is then dried at room temperature for about 2 to about 3 hours to remove excess water from the gel-coating, and the sieve is removed to form a net-structured gel-coated tobacco product.

EXAMPLE 4

1.5 grams of MST is molded into a cube shape to form a pre-portioned piece of MST. Then, a 40 mesh test sieve is placed over the pre-portioned piece of MST. A hot coating solution of 2.5% pectin, 0.15% alginate, 4% dextrin and balance water having a temperature of about 50° C. to about 99° C. is sprayed onto the pre-portioned piece of MST through the sieve. The coated MST is then dried at room temperature for about 2 to about 3 hours to remove excess water from the gel-coating, and the sieve is removed to form a net-structured gel-coated tobacco product.

EXAMPLE 5

1.5 grams of MST is molded into a cube shape to form a pre-portioned piece of MST. Then, a 20 mesh test sieve is placed over the pre-portioned piece of MST. A coating solution of 2.5% pectin, 0.15% alginate, 4% dextrin and balance water is sprayed onto the pre-portioned piece of MST through the sieve. The coated MST is then dried at room temperature for about 2 to about 3 hours to remove excess water from the gel-coating, and the sieve is removed to form a net-structured gel-coated tobacco product.

In a third method, the pouch wrapper is formed by first forming a coating comprising at least two materials of different solubility and then applying a solvent to dissolve out the more readily soluble material. Preferably, the coating includes a first material and a second material. The first material is more readily soluble material and forms one or more first, more readily soluble, regions laterally dispersed in, and separated by, one or more second regions formed from the less readily soluble material (the second material). In the preferred embodiment, the first material is a soluble component and the second material is an insoluble component. Preferably, some or all of the first regions are removed prior to consumer use by contacting the coating with a solvent, such as water.

In an embodiment, the coating can comprise a film formed of the first material and the second material. Removal of the first regions of the film with the solvent can occur either before or after portioning of the tobacco material into the film and the sealing of the film around the tobacco material.

By varying the relative concentrations of the first and second materials, and by varying the degree of homogenization of the mixture of these, as well as the concentration of any emulsifiers and the time between mixing and casting, the relative volume of the first and second regions can be varied. As a result, the total number of perforations, uncoated areas and/or holes in the net-structured gel-coating, the area density of the perforations, uncoated areas and/or holes, and the average diameter of the perforations, uncoated areas and/or holes, can be varied. For example, by using a higher concentration of the first material than the second material, more perforations, uncoated areas and/or holes can be formed in the gel-coating. Likewise, the perforations, uncoated areas and/or holes can be larger than if the coating solution uses a lower concentration of the first material.

The second material, which forms the net-structured gel-coating of the pouch wrapper, may include a variety of materials. Preferably, the second material includes materials that can be dissolved or suspended in a solvent and cast into a film. Suitable materials include biopolymers, such as proteins and polysaccharides. Suitable proteins include materials such as such as gelatin. Suitable polysaccharides include ionically cross-linked polysaccharides, such as alginates, pectins, and/or carrageenans. These polysaccharides can be cross-linked by appropriate monovalent, divalent, or trivalent metal ions, such as sodium ion, potassium ion, calcium ion, or aluminum ion as described above.

The first material, which is dissolved out of the film and/or gel-coating to form a net-structured gel-coating having pores through it, is more soluble in a solvent than the second material. In a particular embodiment, this solvent is water, and the first material can advantageously be a highly water soluble material, optionally combined with a material that can adjust, regulate, or limit the water solubility thereof.

EXAMPLE 6

1.5 grams of MST is molded into a cube shape to form a pre-portioned piece of MST. The pre-portioned piece of MST is then dipped into a coating solution comprising 4% pectin, 0.15% alginate, 4% dextrin and balance water. The coated MST is then immersed in water, to dissolve out the first material, at room temperature for about 10 minutes. The coated MST is then removed from the water and dried at room temperature for about 2 to about 3 hours to remove excess water from the coating.

EXAMPLE 7

1.5 grams of MST is molded into a cube shape to form a pre-portioned piece of MST. The pre-portioned piece of MST is then dipped into a coating solution comprising 4% pectin, 0.15% alginate, 4% dextrin and balance water. The coated MST is then immersed in water, to dissolve out the first material, at room temperature for about 5 minutes. The coated MST is then removed from the water and dried at room temperature for about 2 to about 3 hours to remove excess water from the coating.

EXAMPLE 8

1.5 grams of MST is molded into a cube shape to form a pre-portioned piece of MST. The pre-portioned piece of MST is then dipped into a coating solution comprising 4% pectin, 0.15% alginate, 4% dextrin and balance water. The coated MST is then immersed in water, to dissolve out the first material, at room temperature for about 3 minutes. Prior to immersing the coated MST, the pH of the water is adjusted to accelerate the dissolution of the first material. The coated MST is then removed from the water and dried at room temperature for about 2 to about 3 hours to remove excess water from the coating.

EXAMPLE 9

1.5 grams of MST is molded into a cube shape to form a pre-portioned piece of MST. The pre-portioned piece of MST is then dipped into a coating solution comprising 4% pectin, 0.15% alginate, 4% dextrin and balance water. The coated MST is then immersed in water, to dissolve out the first material, at room temperature for about 15 minutes. Prior to immersing the coated MST, the pH of the water is adjusted to slow the dissolution of the first material. The coated MST is then removed from the water and dried at room temperature for about 2 to about 3 hours to remove excess water from the coating.

In a fourth method, the net-structured, gel-coating can be formed by generating bubbles on the surface of the gel-coating after formation of the gel-coating. The bubbles result in the formation perforations, uncoated areas and/or holes in the gel-coating, thereby forming the net-structure of the gel-coating on the pre-portioned MST.

In a preferred embodiment, bubbles that form the perforations, uncoated areas and/or holes in the gel-coating can be generated using an acid and a base. Preferably, all ingredients used in the gel-coating are food grade ingredients.

Suitable acids include, without limitation, citric acid, malic acid, acetic acid, propionic acid, folic acid, butyric acid, 2-methyl butyric acid, 2-ethyl butyric acid, valeric acid, lactic acid, sorbic acid, adipic acid, benzoic acid, formic acid, fumaric acid, phosphoric acid, succinic acid, tartaric acid, tannic acid, hydrochloric acid and combinations thereof.

Suitable bases include, without limitation, sodium carbonate, sodium bicarbonate, potassium carbonate, potassium bicarbonate, calcium carbonate and combinations thereof.

In a preferred embodiment, the base is added to the gel-coating solution. Preferably, the range of base concentration of the gel-coating solution is about 0.1 wt % to about 20 wt % (e.g., about 1 wt % to about 18 wt %, about 2 wt % to about 15 wt %, about 3 wt % to about 12 wt % or about 4 wt % to about 10 wt %). Most preferably, the range of base concentration of the gel-coating solution is about 1 wt % to about 3 wt % (e.g., about 1.5 wt % to about 2.5 wt % or about 1.75 wt % to about 2.25 wt %).

After coating, the gel-coated tobacco product is contacted with an acid. Typically, the concentration of the acid bath depends on the type of acid used. Since the net-structured gel-coated MST product is placed in the mouth, the pH value of the product should be not lower than about 2. Therefore, the pH value of the acid solution is preferably about 2 to about 7, and more preferably about 4 to about 6. In the preferred embodiment, the temperature of the acid solution is about 25° C. to about 50° C. (e.g., about 30° C. to about 45° C. or about 35° C. to about 40° C.). The treatment time for net-structured gel coatings using the acid/base bubbling technique is about 5 minutes to about 48 hours and more preferably about 1 hour to about 3 hours.

In other embodiments, the perforations, uncoated areas and/or holes can be formed by yeast, a low boiling point liquid, volatile liquids and/or gas.

EXAMPLE 10

1.5 grams of MST is molded into a cube shape to form a pre-portioned piece of MST. The pre-portioned piece of MST is then dipped into a coating solution comprising 4% pectin, 0.15% alginate, 4% dextrin, 1% calcium carbonate and balance water to form a gel-coated piece of MST. The gel-coated piece of MST is then immersed in a citric acid solution having a concentration of about 2.0 wt % at room temperature for about 2 hours to cause formation of perforations, uncoated areas and/or holes which form a net-structured gel-coated piece of MST. The net-structured gel-coated piece of MST is then dried at room temperature for about 2 to about 3 hours to remove excess moisture from the net-structured gel-coating.

EXAMPLE 11

1.5 grams of MST is molded into a cube shape to form a pre-portioned piece of MST. The pre-portioned piece of MST is then dipped into a coating solution comprising 4% pectin, 0.15% alginate, 4% dextrin, 1% calcium carbonate and balance water to form a gel-coated piece of MST. The gel-coated piece of MST is then immersed in a citric acid solution having a concentration of about 2.0 wt % at room temperature for about 2 hours to cause formation of perforations, uncoated areas and/or holes which form a net-structured gel-coated piece of MST. The net-structured gel-coated piece of MST is then dried for 1 hour in a 60° C. convection oven to remove excess moisture from the net-structured gel-coating.

EXAMPLE 12

1.5 grams of MST is molded into a cube shape to form a pre-portioned piece of MST. The pre-portioned piece of MST is then dipped into a coating solution comprising 4% pectin, 0.15% alginate, 4% dextrin, 1% sodium bicarbonate and balance water to form a gel-coated piece of MST. The gel-coated piece of MST is then immersed in a citric acid solution having a concentration of about 2.0 wt % at room temperature for about 2 hours to cause formation of perforations, uncoated areas and/or holes which form a net-structured gel-coated piece of MST. The net-structured gel-coated piece of MST is then dried at room temperature for about 2 to about 3 hours to remove excess moisture from the net-structured gel-coating.

EXAMPLE 13

1.5 grams of MST is molded into a cube shape to form a pre-portioned piece of MST. The pre-portioned piece of MST is then dipped into a coating solution comprising 4% pectin, 0.15% alginate, 4% dextrin, 1% calcium carbonate and balance water to form a gel-coated piece of MST. The gel-coated piece of MST is then immersed in a malic acid solution having a concentration of about 2.0 wt % at room temperature for about 2 hours to cause formation of perforations, uncoated areas and/or holes which form a net-structured gel-coated piece of MST. The net-structured gel-coated piece of MST is then dried for 1 hour in a 60° C. convection oven to remove excess moisture from the net-structured gel-coating.

As illustrated in FIG. 1, preferably, the tobacco product 10 includes a net-structured gel-coating 12 that contacts and/or at least partially covers a piece of tobacco material 16. Preferably, the tobacco material 16 is pre-portioned. Also preferably, the tobacco material 16 is a molded portion of moist smokeless tobacco (MST). The net-structured gel-coating coats at least a portion of the tobacco product 10 and includes multiple perforations, holes and/or non-coated regions 20 where the tobacco material 16 lacks coating. The perforations, holes and/or non-coated regions 20 in the net-structured gel-coating allow for flow of saliva into the tobacco product 10 immediately upon placement in the user's mouth. Preferably, the gel-coating is formed of at least one biopolymer by one of the methods described in detail above. The at least one biopolymer can be a water soluble biopolymer, a water insoluble biopolymer or a combination of these.

In the preferred embodiment, the net-structured gel-coating 12 completely covers the pre-portioned tobacco material 16.

Figure 2:
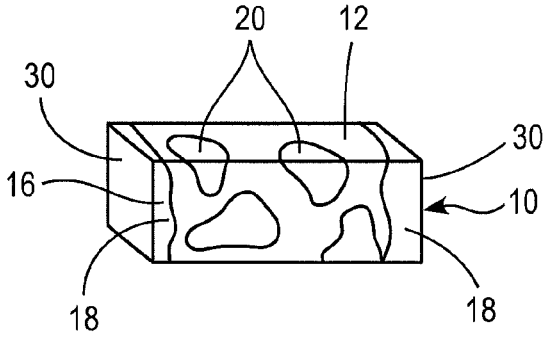
FIG. 2 is an illustration of the pre-portioned oral tobacco product of FIG. 1 having at least one uncoated end and/or side.

In another embodiment, as shown in FIG. 2, the hydrated membrane coating 12 partially covers the pre-portioned tobacco material 16, such that the ends 30 and/or sides 18 of the tobacco material 16 are not coated. Preferably, the exposed ends 30 of the tobacco material 12 are not coated by the coating 12.

Figure 3:
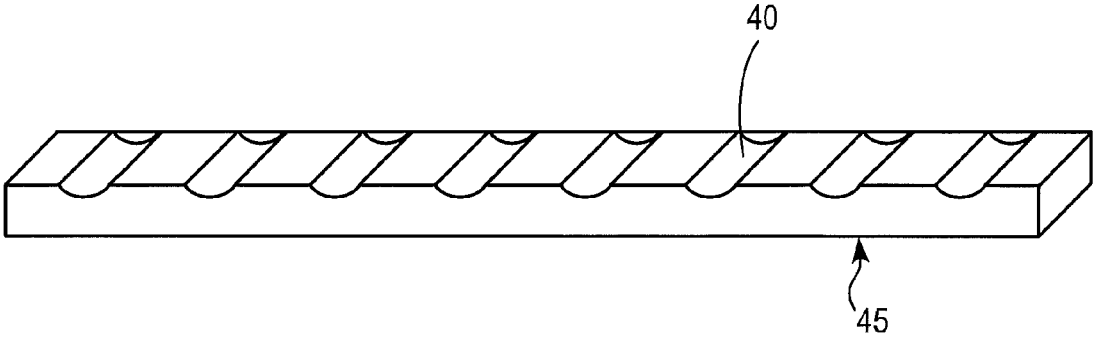
FIG. 3 is an illustration of a mold for forming the pre-portioned oral tobacco product of FIG. 2.

In an embodiment, the pre-portioned tobacco product 10 having exposed (uncoated) ends 30 can be formed on a special mold 45, shown in FIG. 3. The mold 45 provides for application of the coating 12 across the length of a piece of molded tobacco material 16 while on the mold. The coated tobacco product 10 is then broken at segments 40 in the mold 45 such that exposed ends are formed on each portioned piece of net-structured gel-coated tobacco material.

Preferably, the final portioned tobacco product 10 including the net-structured gel-coating weights about 1.0 grams to about 3.0 grams (e.g., about 1.5 grams to about 2.5 grams or about 1.8 grams to about 2.2 grams). The weight is predominately based on the amount of tobacco material 16 used since the weight of the net-structured gel-coating 12 is small as compared to that of the tobacco material 16.

In an embodiment, the shaped tobacco product 10 may be up to about 1.5 inches long, up to 1 inch in height, and up to ¾ inch in width. Preferably, the tobacco product 10 is flexible, compressible and capable of conforming to the shape of the oral cavity.

In another embodiment, the net-structured gel-coating 12 of the tobacco product 10 can also include colorants and/or additional flavorants to enhance the immediate release of flavorants from the tobacco material 16 and the color of the user's saliva. For example, the tobacco product 10 can include a green coating that is mint flavored, such that when placed in the mouth, the user's spit is green-colored. The net-structured gel-coating 12 can include any colorant and/or flavorant that is suitable for use in oral products.

The colorants and/or flavorants can be added to the gel-coating during formation of the gel-coating by adding a suitable amount of the colorant and/or additional flavorants to the polymer solution. Alternatively, the colorants and/or flavorants can be sprayed onto the tobacco product 10 after formation of the net-structured gel-coating. In another embodiment, the colorants and/or flavorants are added to the gel-coating in the form of microcapsules, beads, crystals and the like that quickly dissolve in a user's mouth. Such microcapsules, beads and/or crystals can also provide additional texture to the gel-coating.

EXAMPLE 14

0.2 grams of caramel color No. 050 is mixed with 100 g of the coating solution comprising 2.5% pectin, 0.15% alginate, 4% dextrin and balance water to form a caramel-colored coating solution. 1.5 g MST is then molded into a cube shape and dipped into the colored coating solution to form a coated MST product. The coated MST product is dried at room temperature for about 2 to about 3 hours to remove excess water in the gel-coating. Perforations are then randomly formed in the dried, coated MST product using a 16 gauge needle to form the final net-structured, gel-coated MST product having a colored coating.

EXAMPLE 15

0.6 grams of wintergreen flavor and 0.2 grams of caramel color No. 050 are mixed with 100 g of the coating solution comprising 2.5% pectin, 0.15% alginate, 4% dextrin and balance water to form a colored coating solution. 1.5 g MST is then molded into a cube shape and dipped into the colored coating solution to form a coated MST product. The coated MST product is dried at room temperature for about 2 to about 3 hours to remove excess water in the gel-coating. Perforations are then randomly formed in the dried, coated MST product using a 16 gauge needle to form the final net-structured, gel-coated MST product having a colored coating.

EXAMPLE 16

0.2 grams of tobacco juice is mixed with 100 g of the coating solution comprising 2.5% pectin, 0.15% alginate, 4% dextrin and balance water to form a colored coating solution. 1.5 g MST is then molded into a cube shape and dipped into the colored coating solution to form a coated MST product. The coated MST product is dried at room temperature for about 2 to about 3 hours to remove excess water in the gel-coating. Perforations are then randomly formed in the dried, coated MST product using a laser to form the final net-structured, gel-coated MST product having a colored coating.

In another embodiment, a second coating with colorants, flavors and/or tobacco juices can be formed over the net-structured, gel-coating. The second coating is preferably readily soluble in saliva so that the second coating immediately dissolves upon placement in the user's mouth. The second coating can be formed by adding the colorants, flavorants and/or tobacco juices to a second polymer solution comprising polymers having a high solubility in saliva.

EXAMPLE 17

1.5 grams of MST is first molded into a cube shape and then dipped into a coating solution comprising 2.5% pectin, 0.15% alginate, 4% dextrin and balance water to form a coated portion of MST. The coated portion of MST is then dipped into a second coating solution comprising Purity Gum 59 solution including 38% modified starch, 0.2% caramel color No. 050, and 0.6% wintergreen flavorant. The coated portion of MST is then dried at room temperature for about 2 to about 3 hours to remove excess water from the coatings. The dried, coated MST is then perforated with a 16 gauge needle to form a net-structured, gel-coated MST product.

EXAMPLE 18

1.5 grams of MST is first molded into a cube shape and then dipped into a coating solution comprising 2.5% pectin, 0.15% alginate, 4% dextrin and balance water to form a coated portion of MST. The coated portion of MST is then dipped into a second coating solution comprising 4% low molecular weight pectin, having a molecular weight of about 500 to about 5000, and balance water. The coated portion of MST is then dried at room temperature for about 2 to about 3 hours to remove excess water from the coatings. The dried, coated MST is then perforated with a 16 gauge needle to form a net-structured, gel-coated MST product.

In this specification, the word "about" is often used in connection with numerical values to indicate that mathematical precision of such values is not intended. Accordingly, it is intended that where "about" is used with a numerical value, a tolerance of 10% is contemplated for that numerical value.

While the foregoing describes in detail tobacco products and methods of forming tobacco products with reference to a specific embodiment thereof, it will be apparent to one skilled in the art that various changes and modifications and equivalents to the method of treating tobacco and forming tobacco products may be employed, which do not materially depart from the spirit and scope of the invention.

What is claimed is:

1. A pre-portioned oral tobacco product comprising:

a pre-portioned piece of tobacco material comprising moist smokeless tobacco; and a gel-coating at least partially surrounding the pre-portioned piece of tobacco and having a plurality of perforations, uncoated areas and/or holes extending through a thickness of the gel-coating, interspersed throughout the gel-coating and formed in the gel-coating prior to use; said gel-coating comprising at least one insoluble polymer, wherein each of the perforations, uncoated areas and/or holes is sufficiently small to substantially prevent pieces of the tobacco material from traveling therethrough.

2. The pre-portioned oral tobacco product of claim 1, wherein the bulk density of the oral tobacco product is about $1.0 \pm 0.2$ g/cm$^3$.

3. The pre-portioned oral tobacco product of claim 1, wherein the pre-portioned piece of tobacco material has a length of up to about 1.5 inch, a width of up to about 0.75 inch and a height of up to about 1 inch and wherein the pre-portioned piece of tobacco material weighs about 0.5 g to about 2.5 g.

4. The pre-portioned oral tobacco product of claim 1, wherein the pre-portioned oral tobacco product has one or more ends and sides that are gel-coating-free.

5. The pre-portioned oral tobacco product of claim 1, wherein the gel-coating is about 0.2 mm to about 1.0 mm thick when the gel-coating is removed from the pre-portioned oral tobacco product and dried.

6. The pre-portioned oral tobacco product of claim 1, wherein the gel-coating has a moisture content of about 10% to about 50%.

7. The pre-portioned oral tobacco product of claim 1, further comprising an additive selected from the group consisting of flavorants, sweeteners, preservatives, nutraceuticals, antioxidants, amino acids, minerals, vitamins, botanical extracts, humectants, chemesthetic agents and combinations thereof in the gel-coating and/or the pre-portioned piece of tobacco material.

* * * * *